US010360879B2

(12) United States Patent
Bailey et al.

(10) Patent No.: US 10,360,879 B2
(45) Date of Patent: Jul. 23, 2019

(54) SHOULDER REST FOR BOWED STRING INSTRUMENTS

(71) Applicant: The ArcRest, Inc., Rochester, NY (US)

(72) Inventors: Aaron J. Bailey, Rochester, NY (US); Tigran Vardanyan, Rochester, NY (US)

(73) Assignee: The Arcrest, Inc., Rochester, NY (US)

( * ) Notice: Subject to any disclaimer, the term of this patent is extended or adjusted under 35 U.S.C. 154(b) by 0 days.

(21) Appl. No.: 15/637,052

(22) Filed: Jun. 29, 2017

(65) Prior Publication Data

US 2018/0005610 A1 Jan. 4, 2018

Related U.S. Application Data

(60) Provisional application No. 62/357,431, filed on Jul. 1, 2016.

(51) Int. Cl.
*G10D 3/18* (2006.01)
*G10G 5/00* (2006.01)

(52) U.S. Cl.
CPC ..... *G10D 3/18* (2013.01); *G10G 5/00* (2013.01)

(58) Field of Classification Search
CPC ..... G10G 5/00; G10D 3/18
See application file for complete search history.

(56) References Cited

U.S. PATENT DOCUMENTS

| | | | | |
|---|---|---|---|---|
| 4,506,582 | A | 3/1985 | Goldner | |
| 4,951,541 | A | 8/1990 | McMillan | |
| 5,731,531 | A | 3/1998 | Kun | |
| D406,269 | S | 3/1999 | Mach | |
| 6,291,750 | B1 * | 9/2001 | Farha | G10D 3/18 84/278 |
| 7,265,284 | B2 | 9/2007 | Muir et al. | |
| 7,323,627 | B2 | 1/2008 | Sweeney | |
| 7,488,877 | B2 | 2/2009 | Cheng et al. | |
| 8,119,894 | B2 | 2/2012 | Cheng et al. | |
| 8,704,065 | B2 | 4/2014 | Korfker | |
| D717,366 | S * | 11/2014 | Korfker | D17/20 |
| D737,893 | S | 9/2015 | Stern | |
| 9,311,903 | B1 | 4/2016 | Balatti et al. | |

* cited by examiner

*Primary Examiner* — Kimberly R Lockett
(74) *Attorney, Agent, or Firm* — Barclay Damon LLP

(57) ABSTRACT

A shoulder rest for a bowed string instrument comprises a curved base with a top surface and a bottom surface. The top surface has a first attachment element. A resilient pad has a second attachment element facing the first attachment element. The second attachment element is configured to removably couple to the first attachment element. A plurality of engagement members is coupled to the bottom surface of the curved base and configured to prevent the curved base from contacting the bowed string instrument during use.

15 Claims, 6 Drawing Sheets

SHOULDER REST FOR BOWED STRING INSTRUMENTS

CROSS REFERENCE TO RELATED APPLICATION

Pursuant to relevant portions of 35 U.S.C. § 119 and 37 C.F.R. § 1.53, this application claims the benefit and priority of U.S. Patent Application No. 62/357,431, filed on Jul. 1, 2016. The entire contents of this application is hereby incorporated by reference.

TECHNICAL FIELD

This application is directed generally to the field of accessories for musical instruments and more specifically to a shoulder rest for a bowed string instrument comprising a curved base having a plurality of engagement members and removably coupled to a resilient pad.

BACKGROUND

The proper playing posture for bowed string musical instruments such as violins and violas requires the user or musician to secure a portion of the instrument between the their chin and their collar bone. In this position, there is a gap between the underside of the instrument and the user's body. A shoulder rest is used to "fill" this gap and provide support for the instrument, cushioning for the user, and help prevent shoulder strain.

Bridge style shoulder rests are commonly used with bowed string instruments and include two clamping elements with a rigid pad suspended between them. The clamping elements are manually adjusted in order to couple the shoulder rest to the instrument. While these shoulder rests provide for secure attachment to the instrument, they are not easily installed on the instrument, and are not able to be adjusted while the instrument is being played, which is recognized to be an important part of proper posture and playing technique. Moreover, the construction and heaviness of these shoulder rests cause significant sound dampening and make them cumbersome to transport and store.

Other shoulder rests use pads that are attached directly to the back of the instrument. These shoulder rests use a temporary adhesive or one or more elastic bands to retain the pad or pads against the bottom surface of the instrument. The benefit of these shoulder rests is that they are generally easy to install and store while allowing for free movement and adjustment during use. However, having the large surface of the pad or a separate backing in direct contact with the instrument produces significant sound dampening. Moreover, such pads tend to be too thick such that, when in use, they do not allow a portion of the instrument to sit on the user's collar bone. This will cause the user's arms to be held in and unnatural position and become strained over time while playing.

The foregoing background describes some, but not necessarily all, of the problems, disadvantages and shortcomings related to current shoulder rests. There is a general and pervasive need in the field to provide a shoulder rest that is easy to install on the instrument and store while also being easily adjusted by the musician and providing minimal interference with the sound production of the instrument when in use.

SUMMARY

In an embodiment, a shoulder rest for a bowed string instrument comprises a curved base having a top surface and a bottom surface. The top surface includes a first attachment element. An anchoring surface is disposed proximate opposite ends of the first attachment element. The shoulder rest further includes a resilient pad comprising a cushion portion and a backing portion. The backing portion has a second attachment element configured to removably couple to the first attachment element. A gap is defined between the backing portion and the anchoring surface. A plurality of engagement members are coupled to the bottom surface of the curved base and configured to prevent the curved base from contacting the bowed string instrument during use.

In an embodiment, the shoulder rest for a bowed string instrument comprises a curved base having a top surface and a bottom surface, wherein the top surface includes a first attachment element. The shoulder rest further includes a resilient pad having a second attachment element facing the first attachment element and configured to removably couple to the first attachment element. A plurality of engagement members are coupled to the bottom surface of the curved base and configured to prevent the curved base from contacting the instrument during use.

In and embodiment, the shoulder rest can be comprised of lightweight material and configured to minimally contact the instrument in order to preserve sound quality, while being freely adjustable during play and still providing needed support to the user.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION

The following discussion relates to various embodiments of a shoulder rest for bowed string instruments. It will be understood that the herein described versions are examples that embody certain inventive concepts as detailed herein.

To that end, other variations and modifications will be readily apparent to those of sufficient skill. In addition, certain terms are used throughout this discussion in order to provide a suitable frame of reference with regard to the accompanying drawings. These terms such as "outer", "inner", "top", "bottom", "forward", "rearward", "interior", "exterior", "front", "back" and the like are not intended to limit these concepts, except where so specifically indicated. With regard to the drawings, their purpose is to depict salient features of the inventive dual mode closure and are not specifically provided to scale.

Figure 1:
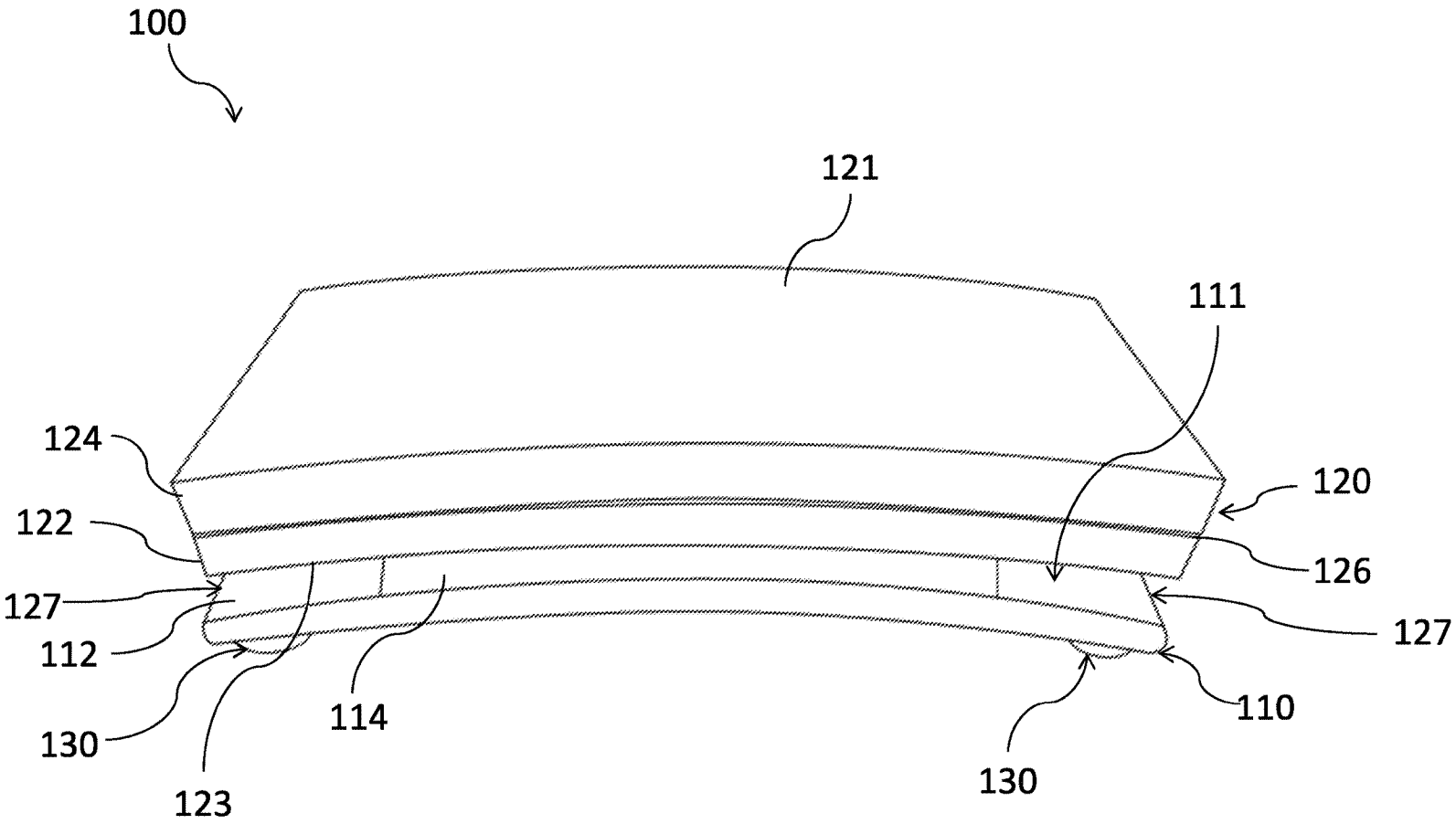
FIG. 1 illustrates an isometric front view of an embodiment of a shoulder rest for bowed string instruments.
Figure 2:
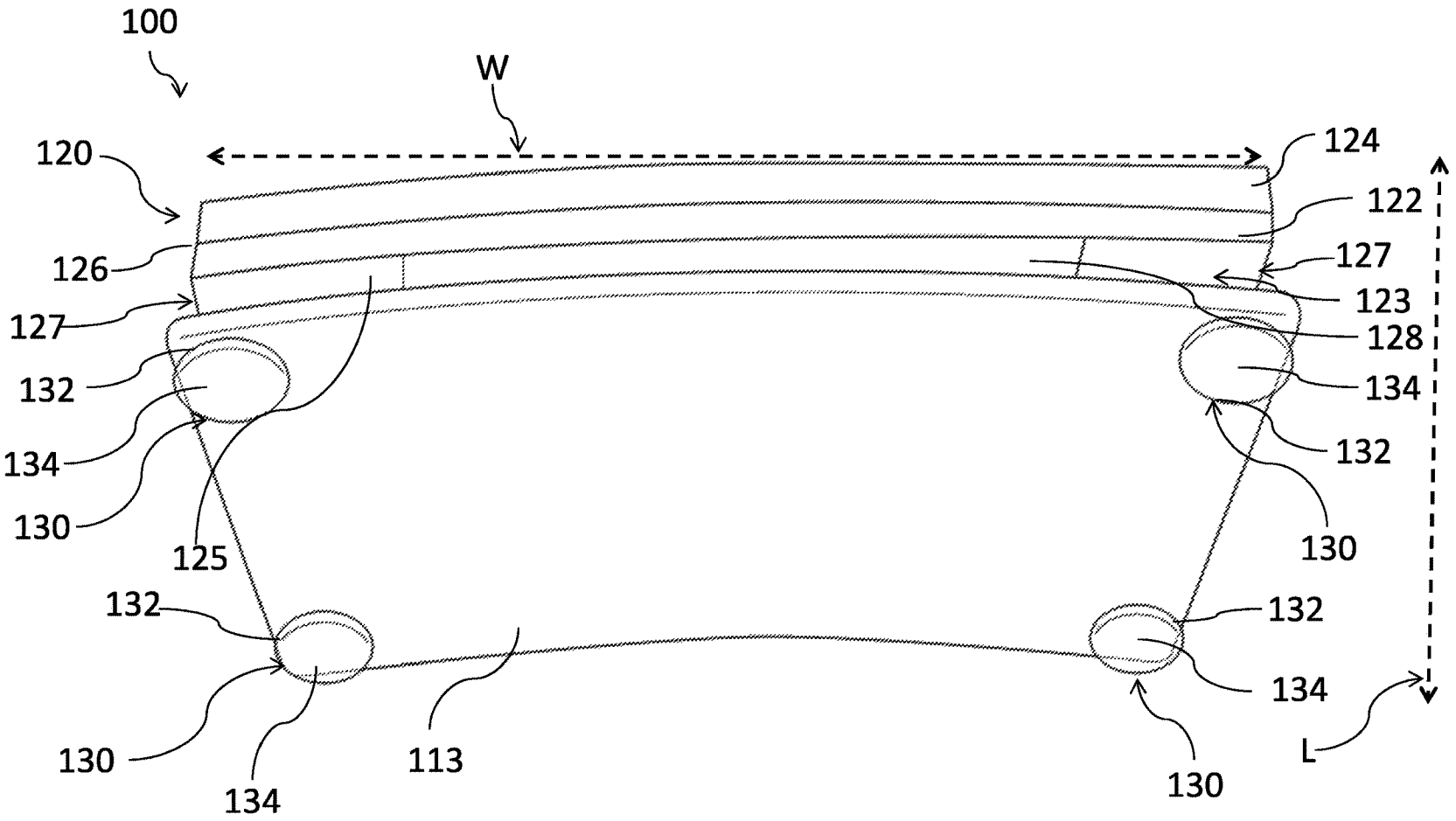
FIG. 2 illustrates an isometric bottom view of an embodiment of the shoulder rest for bowed string instruments.

Referring to FIGS. 1 and 2, a shoulder rest for bowed string instruments, or a shoulder rest 100, generally comprises a base 110, a resilient pad 120, and a plurality of engagement members 130.

In an embodiment, the base 110 has a top surface 111 (FIG. 1) and a bottom surface 113 (FIG. 2) and is a semi-rigid structure that is configured to flex in response to axial and radial forces. As shown in FIGS. 1 and 2, the base 110 can be curved to enable it to sit more securely on a surface or body 154 (FIGS. 4-6) of an instrument such as a violin, viola, or other such instrument, which requires a shoulder rest 100 to play. In an embodiment, the radius of the curvature of the base 110 is not less than 5.5 inches, but ideally is between 6.25 inches and 10.25 inches. Accordingly, the radius of the base 110 can be different in different embodiments depending on the type and size of instrument with which the shoulder rest 100 is being used. The base 110 can have dimensions of about 2 inches by about 4 inches with a thickness from about 0.03125 inches to about 0.1875 inches. The term "about" as used in this disclosure covers a range that is between 80-120% of the disclosed amount or value. The about 2 inch by about 4 inch base 110 size is generally for use with a full size violin and viola.

The surface area of the base 110 can be proportional to the estimated area of the body 154 (FIGS. 4-6) such that larger instruments will best be suited by a proportionally larger base 110 and smaller instruments will best be suited by a proportionally smaller base 110. The estimated area of the body 154 (FIGS. 4-6) can be determined by treating the body 154 (FIGS. 4-6) as a rectangle and determining the area of said rectangle. Some examples of proper sizing of the base 110 are shown in Table 1 and Table 2 below. In Table 1, a full sized violin has a size of 4/4 and in Table 2, a full sized viola has a size of 14 inches.

TABLE 1

| Violin Size | Body Length (Inches) | Overall Length (Inches) | Max. Width (Inches) | Rectangular Area (Inches$^2$) | % size as compared to full size violin | Shoulder Rest Width (Inches) | Shoulder Rest Length (Inches) |
|---|---|---|---|---|---|---|---|
| 4/4 | 14 | 23.5 | 7.5 | 105 | 100.00 | 2.00 | 4.00 |
| 7/8 | 13.5 | 22.5 | 7.25 | 97.875 | 93.2 | 1.93 | 3.86 |
| 3/4 | 13 | 21.75 | 7 | 91 | 86.7 | 1.86 | 3.72 |
| 1/2 | 12.5 | 20.5 | 6.75 | 84.375 | 80.4 | 1.79 | 3.59 |
| 1/4 | 11.5 | 18.75 | 6 | 69 | 65.7 | 1.62 | 3.24 |
| 1/8 | 10.25 | 17.25 | 5.5 | 56.375 | 53.7 | 1.47 | 2.93 |
| 1/10 | 9.25 | 16 | 5 | 46.25 | 44.0 | 1.33 | 2.65 |
| 1/16 | 8.25 | 14.5 | 4.45 | 36.713 | 35.0 | 1.18 | 2.37 |

TABLE 2

| Viola Size (Inches) | Body Length (Inches) | Overall Length (Inches) | Max. Width (Inches) | Rectangular Area (Inches$^2$) | % Size as compared to standard size viola | Shoulder Rest Width (Inches) | Shoulder Rest Length (Inches) |
|---|---|---|---|---|---|---|---|
| 16.5 | 16.5 | 27 | 9 | 148.5 | 141.4 | 2.38 | 4.76 |
| 16 | 16 | 26.5 | 8.75 | 140 | 133.3 | 2.31 | 4.62 |
| 15.5 | 15.5 | 26 | 8.5 | 131.75 | 125.5 | 2.24 | 4.48 |
| 15 | 15 | 25 | 8 | 120 | 114.3 | 2.14 | 4.28 |
| 14 | 14 | 23 | 7.5 | 105 | 100.0 | 2.00 | 4.00 |
| 13 | 13 | 21.75 | 7 | 91 | 86.7 | 1.86 | 3.72 |
| 12 | 12 | 20.5 | 6.75 | 81 | 77.1 | 1.76 | 3.51 |

Referring to FIG. 1, the base 110 may include an attachment element 114 that covers at least a portion of the top surface 111. As shown, the attachment element 114 is centrally disposed on the top surface 111, however, in other embodiments, the attachment element 114 is not centrally disposed on the top surface 111. As shown in FIG. 1, an anchoring surface 112 may be disposed on opposite sides of the attachment element 114. In another embodiment, the anchoring surface 112 may substantially or completely surround the attachment element 114. In an embodiment, the anchoring surface 112 may be textured or have a textured, tacky or other such non-slip coating applied to it in order increase the coefficient of friction of the anchoring surface 112.

Figure 3:
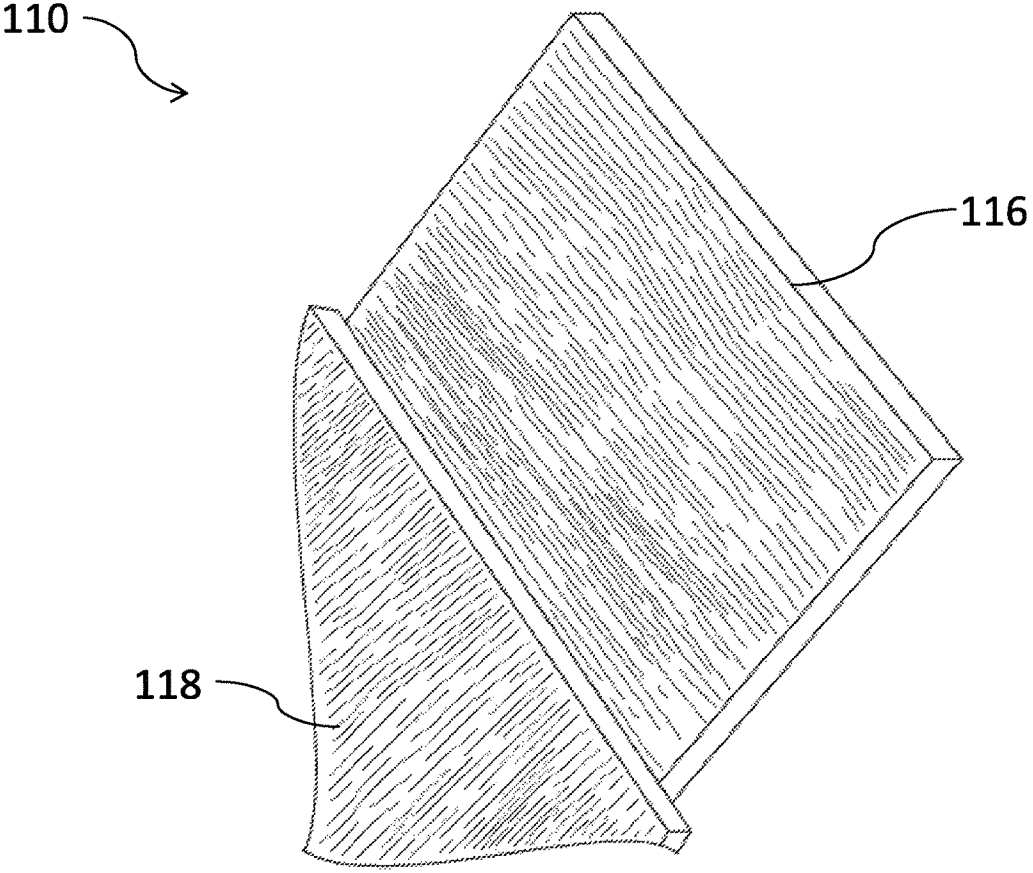
FIG. 3 illustrates an isometric top view of the wood grain orientation in an embodiment of the shoulder rest for bowed string instruments.
Figure 4:
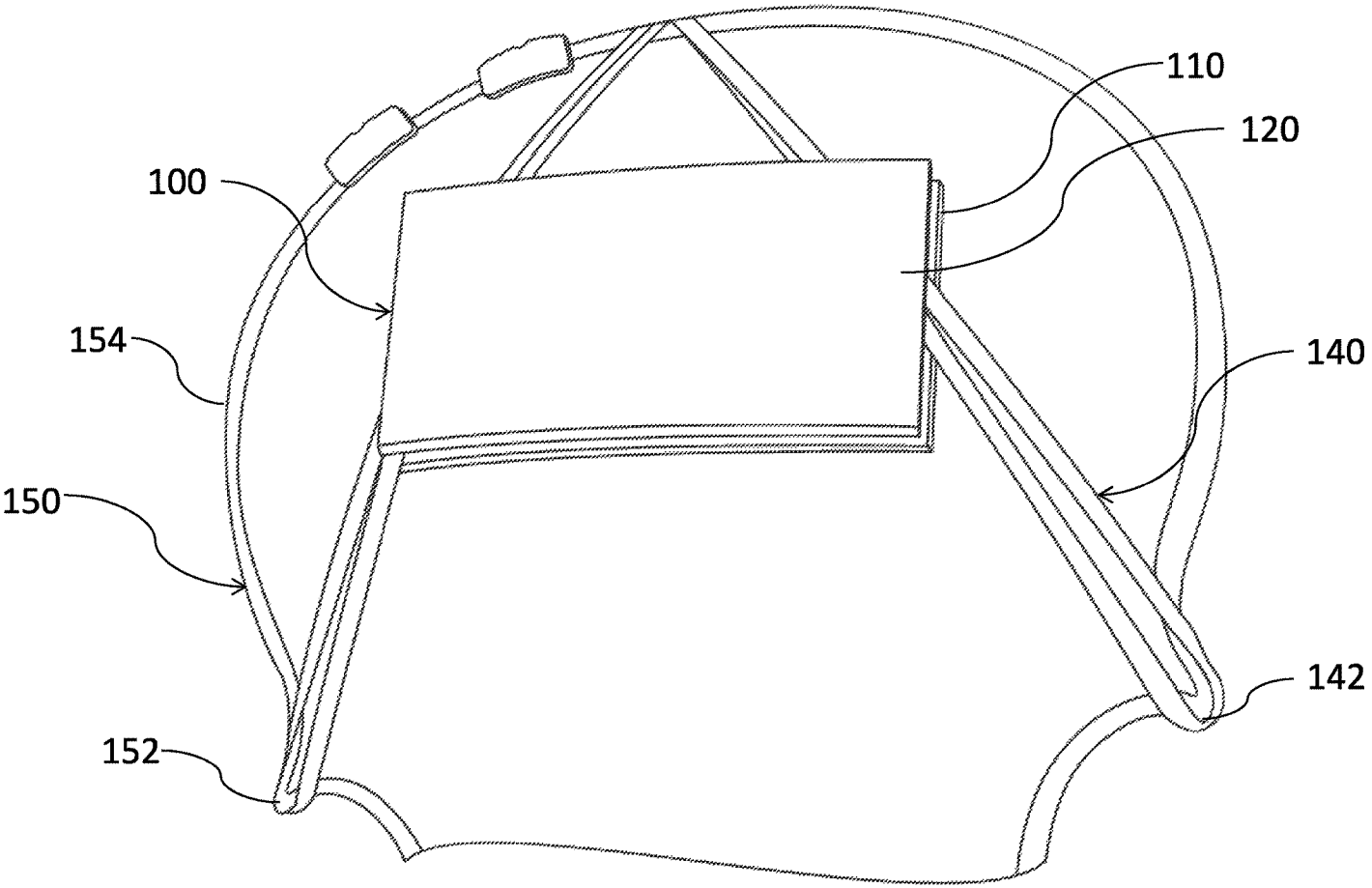
FIG. 4 illustrates an isometric top view of an embodiment of the shoulder rest for bowed string instruments attached to a bowed string instrument by a coupler.
Figure 5:
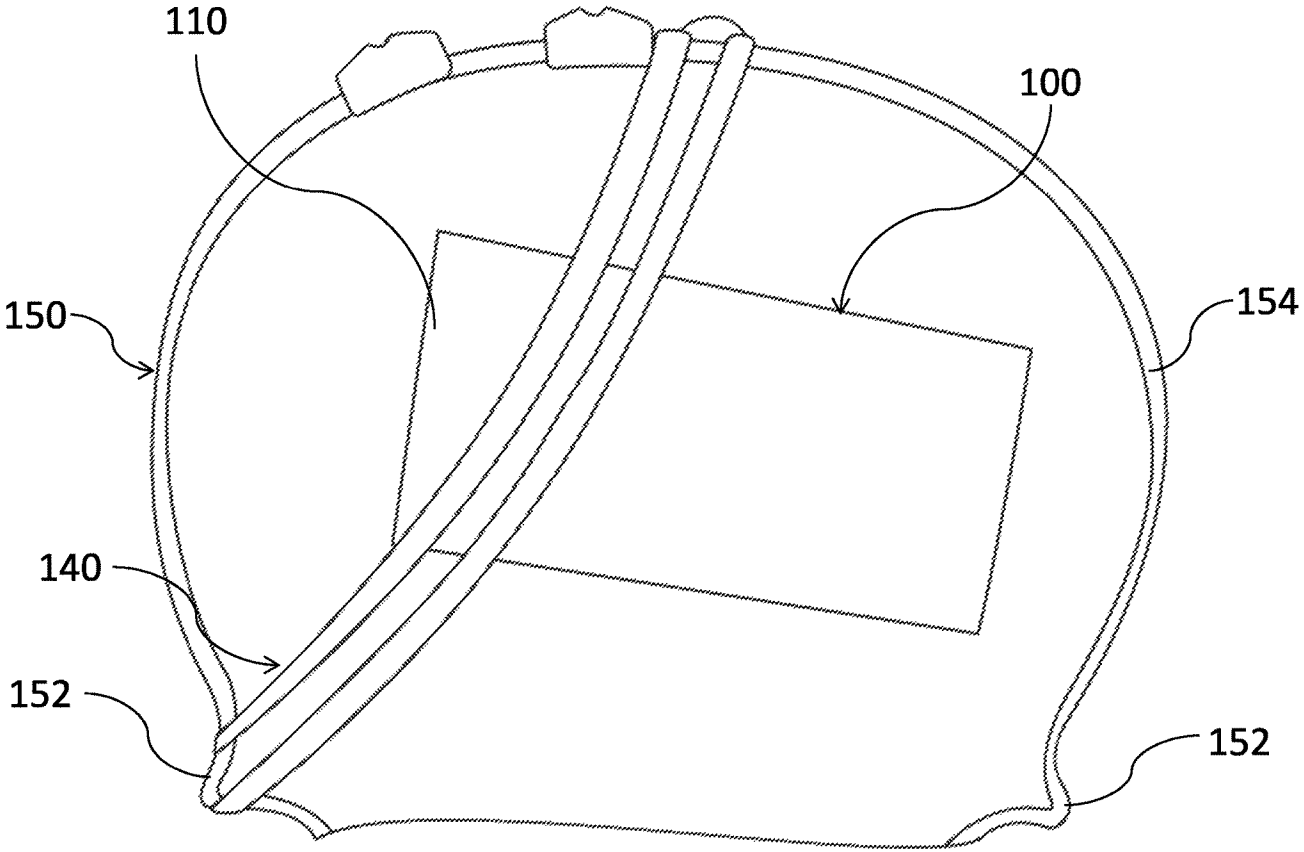
FIG. 5 illustrates a top plan view of an embodiment of the shoulder rest for bowed string instruments attached to a bowed string instrument by a coupler.
Figure 6:
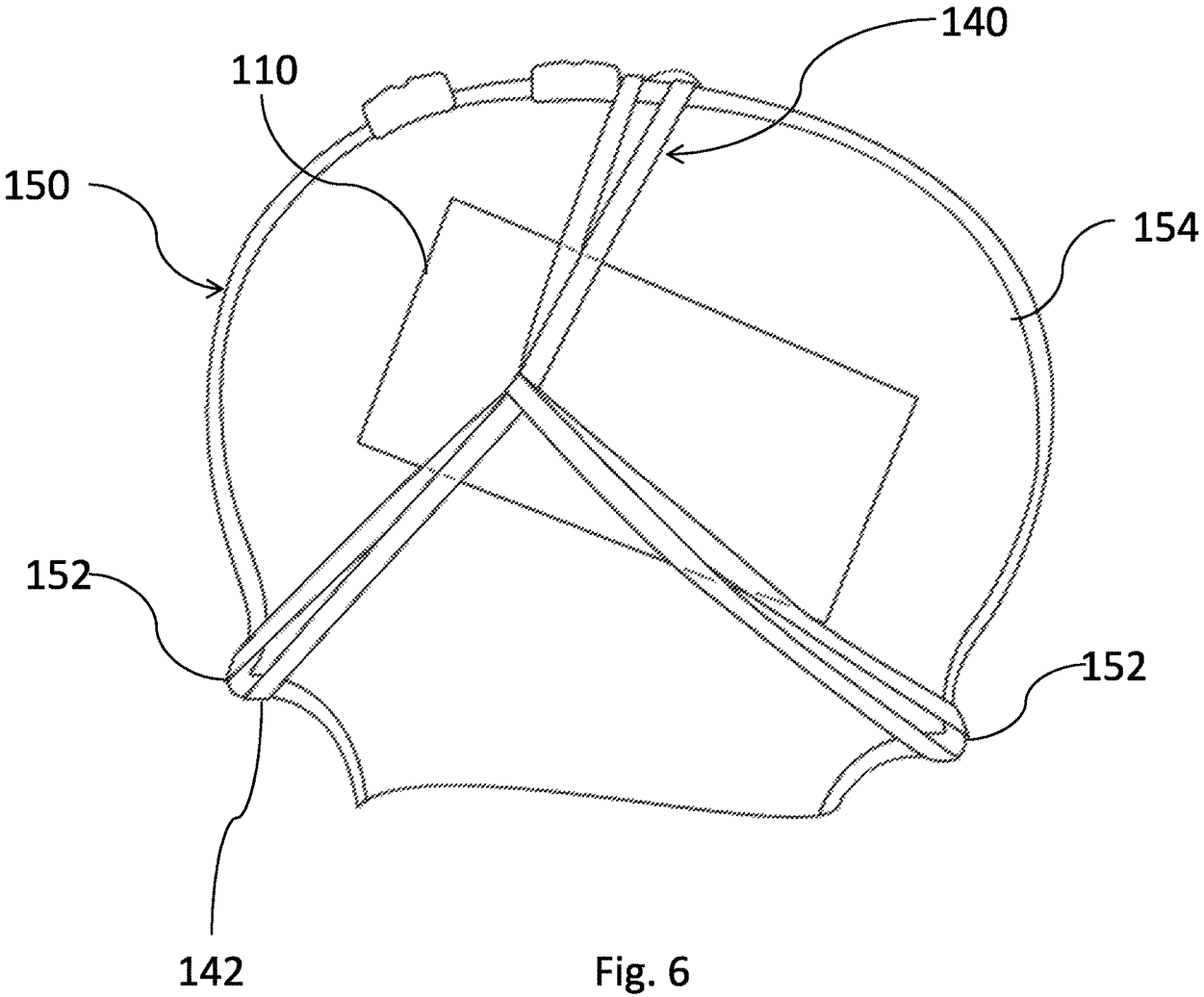
FIG. 6 illustrates a top plan view of an embodiment of the shoulder rest for bowed string instruments attached to a bowed string instrument by a coupler.

The base 110 can be configured to flex in response to axial and radial forces, however the base 110 is rigid enough such that it will not flex into contact with the instrument 150 (FIGS. 4-6) during use. Contact between the base 110 and the instrument 150 (FIGS. 4-6) will negatively affect the resonance of the instrument 150 (FIGS. 4-6). The base 110 may be made of, e.g., carbon fiber, wood, wood composite, plastic, laminate, fiber glass, hemp foam composite, or other lightweight, semi-rigid material or combinations thereof. As shown in FIG. 3, the base 110 may comprise more than one layer of wood or other lightweight material. The use of heavy materials for the base 110 adds extra weight to the shoulder rest 100, which in turn negatively affects the resonance of the instrument 150 (FIGS. 4-6). Still referring to the embodiment of FIG. 3, the base 110 may comprise a first layer 116 of material that is oriented so that the grain of the material is parallel to axis L (FIG. 2) and the second layer 118 of material that is oriented such that its grain is perpendicular to axis L (FIG. 2) or parallel to axis W (FIG. 2). This configuration improves the strength and durability of the base 110 while still allowing it to retain some flexibility. In another embodiment, the base 110 may comprise a single layer of material. In still another embodiment, the base may comprise two or more layers of different types of materials.

Referring to FIGS. 1 and 2, a resilient pad 120 has a top surface 121 and a bottom surface 123 and can be coupled to the top surface 111 of the base 110. As shown, the resilient pad 120 may comprise a backing 122 and a cushion 124. The backing 122 and the cushion 124 may be comprised of different materials or may be layers of the same material. In an embodiment, the backing 122 may be comprised of a denser material than the cushion 124, however in other embodiments the backing 122 may not be comprised of a denser material than the cushion 124. In the embodiment shown, the backing 122 and the cushion 124 may be coupled together at a junction 126. In an embodiment, the junction 126 may comprise a temporary fastening means such as one or more snaps, a hook and loop material, one or more magnets, or other such temporary fastening means. In another embodiment, the junction 126 may comprise a permanent fastening means such as an adhesive, a melted bond, or any other means to permanently join the backing 122 and the cushion 124 together.

In an embodiment, the density of the material comprising the resilient pad 120 can be less than about 20 $lbs/ft^3$. Material that is too dense adds extra weight to the shoulder rest 100, which in turn negatively affects the resonance of the instrument 150 (FIGS. 4-6). In an embodiment, the 25% compression strength of the resilient pad 120 may be from about 4 to about 7 psi (as defined by ASTM D1056). The resilient pad 120 may be comprised of ethyl vinyl acetate (EVA), polyethylene (PE), ionomer, a blend of neoprene, ethylene propylene diene terpolymer (EPDM), styrene butadiene rubber (SBR), or any other suitable material or any combination thereof that provides the desired cushioning properties while also being lightweight and resilient.

As shown in FIG. 2, the backing 122 can have a bottom surface 125 that faces the top surface 111 of the base 110. The bottom surface 125 of the backing 122 may include an attachment element 128 that is centrally disposed on the bottom surface 125 of the backing 122, however in other embodiments the attachment element 128 of the backing 122 is not centrally disposed on the bottom surface 125 of the backing 122. The attachment element 128 of the backing 122 can be configured to interact with the attachment element 114 of the base 110 to removably couple the resilient pad 120 to the base 110. The attachment elements 114, 128 may comprise a hook and loop configuration, one or more snaps, magnets, clips, pins, or any other reusable, temporary attachment means that provides fast attachment and detachment of the resilient pad 120 and base 110. The attachment elements 114, 128 allow the user to switch between different resilient pads 120 while using the same base 110.

Still referring to FIG. 2, the bottom surface 113 of the base 110 may include at least four (4) engagement members 130. As shown, the engagement members 130 can be disposed toward the corners of the bottom surface 113 of the base 110, however in other embodiments, the engagement members 130 may not be disposed toward the corners of the bottom surface 113 of the base 110. As illustrated in FIG. 2, the engagement members 130 can be hemispherical in shape with a flat end 132 for contacting and attaching to the bottom surface 113 of the base 110. The opposing end or engagement end 134 of the engagement member 130 can be configured to contact a surface or body 154 (FIGS. 4-6) of the instrument 150 (FIGS. 4-6) without sliding along or damaging the body 154 (FIGS. 4-6) of the instrument 150 (FIGS. 4-6). The hemispherical shape of the engagement members 130 provides for a large flat end 132 which can be secured to the bottom surface 113 of the base 110 using an adhesive, one or more mechanical fasteners, or any other suitable means to securely fasten the engagement member 130 to the bottom surface 113 of the base 110. In addition, the hemispherical shape of the engagement members 130 provides an engagement end 134 that has a very small surface area contacting the body 154 (FIGS. 4-6) so as to provide minimal interference to the sound quality or resonance of the instrument 150 (FIGS. 4-6). In other embodiments, the engagement members 130 may be pyramidal or any other shape that provides for a large flat end 132 and a very small engagement end 134.

As shown, the engagement members 130 can be comprised of a semi-soft material that has the ability to compress, which increases the ability of the engagement members 130 to grip the body 154 (FIGS. 4-6) of the instrument 150 (FIGS. 4-6). The ability of the engagement members 130 to compress also prevents slippage of the shoulder rest 100 as well as damage to the instrument 150 (FIGS. 4-6). Engagement members 130 that are rigid and do not compress will provide an engagement end 134 with a very small surface area, however they will not sufficiently grip the instrument 150 (FIGS. 4-6). Furthermore, they may actually cause damage to the instrument 150 (FIGS. 4-6) as they are pressed against the instrument 150 (FIGS. 4-6) while the user plays. On the other hand, engagement members 130 that are very soft will provide good grip against the surface of the instrument 150 (FIGS. 4-6) thereby preventing slippage and damage to the instrument 150 (FIGS. 4-6). However, very soft engagement members 130 are compressed more during playing, which increases the surface area of the engagement ends 134 and can result in a portion of the base 110 coming into contact with the instrument 150 or body 154 (FIGS. 4-6). Both of these situations negatively affect the resonance of the instrument 150 (FIGS. 4-6) and should be avoided.

As shown in FIG. 2, the engagement members 130 are hard enough to prevent any portion of the base 110 from contacting the instrument 150 (FIGS. 4-6) when the shoulder rest 100 is in use, but soft enough to prevent damage to the instrument 150 (FIGS. 4-6) and unwanted slippage of the shoulder rest 100 when in use. The engagement members 130 can be comprised of a material that has a hardness of about 30 to about 50 durometers (Shore A). The engagement members 130 may be comprised of plastic, sorbothane, silicone, or any other suitable material or combination of materials that provide the desired properties.

In order to use the shoulder rest 100, the resilient pad 120 can be coupled to the base 110 by means of the attachment elements 114, 128. As shown, when the resilient pad 120 is attached to the base 110, it may be approximately the same size as the base 110 as it is measured in a straight line along the W and L axes (FIG. 2). In other embodiments, the resilient pad 120 may not be approximately the same size as the base 110 as it is measured in a straight line along the W and L axes (FIG. 2). Referring to FIGS. 1 and 2, the attachment of the resilient pad 120 to the base 110 can leave a gap 127 between the anchoring surface 112 and the bottom surface 125 of the backing 122.

The overall weight of the shoulder rest 100 has been shown to play an important role in preserving the sound quality of the instrument on which it is being used. As described and illustrated in FIGS. 1-6, the shoulder rest 100 can have a total weight that is not more than about 1 ounce or about 28 grams. Accordingly, the individual weights of the various components that make up the shoulder rest 100 may vary with respect to each other to account for the desired properties. For example, in an embodiment, the base 110 may weigh less than the resilient pad 120.

Referring to FIG. 4, a coupler 140 can be configured to pass through or occupy at least a portion of the gap 127 and contact at least a portion of the anchoring surface 112. As shown, at least one end 142 of the coupler 140 can be attached to a corner 152 of the body 154 of the instrument 150. A portion of the coupler 140 may pass through the gap 127 and contacts the anchoring surface 112 of the base 110, thereby applying an axial force to the anchoring surface 112 to hold the shoulder rest 100 against the body 154 of the instrument 150. Referring to the embodiments illustrated in FIGS. 5 and 6, the coupler 140 may not engage the anchoring surface 112 of the base 110 and instead may contact the cushion 124 and apply an axial force to the cushion 124 in order to secure the shoulder rest 100 to the body 154 of the instrument 150. It can be appreciated that the coupler 140 may be placed in many different orientations and may contact different portions of the shoulder rest 100 than those illustrated. In other embodiments, two or more couplers 140 may be used to secure the shoulder rest 100 to the instrument 150.

As shown in FIGS. 4-6, the coupler 140 can be an elastomeric band comprised of rubber, silicone, or any other suitable elastomeric material that can be stretched, compressed, or otherwise manipulated to removably couple the shoulder rest 100 to an instrument 150 while allowing for natural movement of the shoulder rest 100 during use.

In addition to cushioning the musician's shoulder when playing the instrument 150, the shoulder rest 100 improves positioning of the instrument 150 and playing posture by filling the gap between the instrument 150 (FIGS. 4-6) and the body (not shown) of the user while allowing a portion of the instrument 150 (FIGS. 4-6) to rest on the collar bone of the user and providing ample support. This protects the user from shoulder and arm strain while playing. Moreover, the ability to remove the resilient pad 120 from the base 110 allows many different types and thicknesses of resilient pads 120 to be used to accommodate the different body types of different users. The infinite adjustability of the shoulder rest 100 on the body 154 of the instrument 150 allows it to be optimally positioned to provide custom support to each musician.

PARTS LIST FOR FIGS. 1-6

100—Shoulder rest
110—Base
111—Top surface, base
112—Anchoring surface
113—Bottom surface, base
114—Attachment element, base
120—Resilient pad
121—Top, resilient pad
122—Backing
123—Bottom, resilient pad
124—Cushion
125—Bottom surface, backing
126—Junction
127—Gap
128—Attachment element, backing
130—Engagement member
132—Flat end, engagement member
134—Engagement end, engagement member
140—Coupler
142—Coupler end
150—Bowed string instrument (i.e., violin)
152—Corner
154—Body Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. A shoulder rest for a bowed string instrument comprising:

a curved base having a top surface and a bottom surface, the top surface including a first attachment element and the bottom surface being concavely curved;

an anchoring surface disposed proximate opposite ends of the first attachment element;

a resilient pad comprising a cushion portion and a backing portion, the backing portion having a second attachment element configured to removably couple to the first attachment element;

a gap defined between the backing portion and the anchoring surface; and a plurality of engagement members coupled to the bottom surface of the curved base and configured to prevent the curved base from contacting the bowed string instrument during use.

2. The shoulder rest of claim 1, wherein the curved base has a radius of curvature that is at least about 5.5 inches.

3. The shoulder rest of claim 1, wherein the gap is configured to receive a coupler, and wherein the coupler is configured to contact the anchoring surface and retain the curved base against a surface of the bowed string instrument.

4. The shoulder rest of claim 1, wherein the cushion portion and the backing portion are each comprised of different materials.

5. The shoulder rest of claim 1, wherein the cushion portion and the backing portion are not each comprised of different materials.

6. The shoulder rest of claim 3, wherein the curved base comprises more than one layer of material.

7. The shoulder rest of claim 6, wherein the curved base comprises a first layer of material and a second layer of material, the first layer of material and the second layer of material having a grain.

8. The shoulder rest of claim 7, wherein the grain of the first layer of material is perpendicular to the grain of the second layer of material.

9. The shoulder rest of claim 1, wherein the plurality of engagement members are elastomeric.

10. A shoulder rest for a bowed string instrument comprising:

a curved base having a top surface and a bottom surface, the top surface including a first attachment element and the bottom surface being concavely curved;

a resilient pad having a second attachment element facing the first attachment element and configured to removably couple to the first attachment element; and a plurality of engagement members coupled to the bottom surface of the curved base and configured to prevent the curved base from contacting the bowed string instrument during use.

11. The shoulder rest of claim 10, further comprising an anchoring surface disposed proximate opposite ends of the first attachment element.

12. The shoulder rest of claim 10, wherein the resilient pad comprises a cushion portion and a backing portion.

13. The shoulder rest of claim 11, further comprising a gap defined between the resilient pad and the anchoring surface.

14. The shoulder rest of claim 13, further comprising a coupler configured to be received within the gap and contact the anchoring surface and retain the curved base against a surface of the bowed string instrument.

15. The shoulder rest of claim 10, further comprising a coupler configured to contact a portion of the resilient pad and retain the curved base against a surface of the bowed string instrument.

* * * * *